US012066219B2

(12) United States Patent
Kim et al.

(10) Patent No.: US 12,066,219 B2
(45) Date of Patent: Aug. 20, 2024

(54) COOLING SYSTEM

(71) Applicant: SAMSUNG HEAVY IND. CO., LTD., Seoul (KR)

(72) Inventors: Tae Yun Kim, Gyeongsangnam-do (KR); Hyun Ki Park, Gyeongsangnam-do (KR); Chul Woo Kim, Gyeongsangnam-do (KR); Dong Hun Lee, Gyeongsangnam-do (KR)

(73) Assignee: SAMSUNG HEAVY IND. CO., LTD., Seongnam-si (KR)

( * ) Notice: Subject to any disclaimer, the term of this patent is extended or adjusted under 35 U.S.C. 154(b) by 429 days.

(21) Appl. No.: 17/600,019

(22) PCT Filed: Apr. 1, 2019

(86) PCT No.: PCT/KR2019/003789
§ 371 (c)(1),
(2) Date: Sep. 29, 2021

(87) PCT Pub. No.: WO2020/204218
PCT Pub. Date: Oct. 8, 2020

(65) Prior Publication Data

US 2022/0186986 A1 Jun. 16, 2022

(51) Int. Cl.
*F25B 1/10* (2006.01)
*F25B 40/00* (2006.01)
(Continued)

(52) U.S. Cl.
CPC ..... *F25B 1/10* (2013.01); *F25B 40/00* (2013.01); *F25B 40/02* (2013.01); *F25B 41/30* (2021.01);
(Continued)

(58) Field of Classification Search
CPC .. F25B 1/10; F25B 40/00; F25B 40/02; F25B 41/30; F25B 43/043; F25B 2400/072;
(Continued)

(56) References Cited

U.S. PATENT DOCUMENTS 3,856,493 A * 12/1974 Bulkley ..... F04C 29/04 417/247
3,929,438 A * 12/1975 Harper ..... F25J 3/0233 62/612
(Continued)

FOREIGN PATENT DOCUMENTS

AU 2003275248 A1 * 5/2004 ..... F25J 1/00
EP 3862655 A1 * 8/2021 ..... F25B 1/10
(Continued)

OTHER PUBLICATIONS

Office Action dated Jun. 7, 2022 for Korean Patent Application No. 10-2019-0037905 and its English translation from Global Dossier.
(Continued)

*Primary Examiner* — Ljiljana V. Ciric
(74) *Attorney, Agent, or Firm* — Ladas & Parry, LLP

(57) ABSTRACT

A cooling system includes a refrigerant circulator which circulates a refrigerant, wherein the refrigerant circulator includes a first compressor configured to pressurize the refrigerant in gaseous state; a first cooler configured to cool the refrigerant pressurized by the first compressor; a first gas-liquid separator configured to separate the refrigerant cooled by the first cooler into a first refrigerant flow of a gas component and a second refrigerant flow of a liquid component; a second compressor configured to pressurize the first refrigerant flow; a second cooler configured to cool the first refrigerant flow pressurized by the second compressor; a second gas-liquid separator configured to separate the refrigerant cooled by the second cooler into a third refrigerant flow of a gas component and a fourth refrigerant flow
(Continued)

of a liquid component; a first expansion member configured to decompress the fourth refrigerant flow.

7 Claims, 2 Drawing Sheets

(51) Int. Cl.

| | |
|---|---|
| ***F25B 40/02*** | (2006.01) |
| ***F25B 41/30*** | (2021.01) |
| ***F25B 43/04*** | (2006.01) |
| ***F25J 1/00*** | (2006.01) |
| ***F25J 1/02*** | (2006.01) |

(52) U.S. Cl.
CPC ..... *F25B 43/043* (2013.01); *F25J 1/0022* (2013.01); *F25J 1/0025* (2013.01); *F25J 1/0055* (2013.01); *F25J 1/0092* (2013.01); *F25J 1/0097* (2013.01); *F25J 1/0212* (2013.01); *F25J 1/0262* (2013.01); *F25J 1/0277* (2013.01); *F25B 2400/072* (2013.01); *F25B 2400/13* (2013.01); *F25B 2400/23* (2013.01); *F25J 2290/32* (2013.01)

(58) Field of Classification Search
CPC . F25B 2400/13; F25B 2400/23; F25J 1/0022; F25J 1/0025; F25J 1/0055; F25J 1/0092; F25J 1/0097; F25J 1/0212; F25J 1/0262; F25J 1/0277; F25J 2290/32
See application file for complete search history.

(56) References Cited

U.S. PATENT DOCUMENTS

| | | | | | |
|---|---|---|---|---|---|
| 4,249,387 | A * | 2/1981 | Crowley | F25J 1/0208 | 62/48.2 |
| 4,727,723 | A * | 3/1988 | Durr | F25J 1/0208 | 62/48.2 |
| 5,161,382 | A * | 11/1992 | Missimer | F25B 25/02 | 62/46.1 |
| 5,600,969 | A * | 2/1997 | Low | F25J 3/0238 | 62/622 |
| 5,826,444 | A * | 10/1998 | Capron | F25J 1/0292 | 62/612 |
| 6,070,429 | A * | 6/2000 | Low | F25J 1/004 | 62/619 |
| 6,631,626 | B1 * | 10/2003 | Hahn | B01D 53/40 | 62/612 |
| 6,691,531 | B1 * | 2/2004 | Martinez | F25J 1/0285 | 62/612 |
| 6,898,949 | B2 * | 5/2005 | Paradowski | F25J 3/066 | 62/621 |
| 7,234,322 | B2 * | 6/2007 | Hahn | F25J 1/0265 | 62/620 |
| 7,310,971 | B2 * | 12/2007 | Eaton | F25J 1/0085 | 62/611 |
| 7,404,300 | B2 * | 7/2008 | Baudat | F25J 1/0052 | 62/612 |
| 7,591,149 | B2 * | 9/2009 | Ransbarger | F25J 1/0045 | 62/611 |
| 7,810,353 | B2 * | 10/2010 | Groll | F25B 31/004 | 62/503 |
| 8,327,651 | B2 * | 12/2012 | Finney | B64D 13/08 | 62/510 |
| 8,381,543 | B2 * | 2/2013 | Ransbarger | F25J 1/004 | 60/776 |
| 8,424,340 | B2 * | 4/2013 | Eaton | F25J 1/0258 | 62/903 |
| 8,671,703 | B2 * | 3/2014 | Mitra | F25B 1/10 | 62/509 |
| 9,335,091 | B2 * | 5/2016 | Qualls | F25J 3/0257 | |
| 9,631,864 | B2 * | 4/2017 | Chen | C10L 3/101 | |
| 9,752,801 | B2 * | 9/2017 | Verma | F25B 1/06 | |
| 10,648,729 | B2 * | 5/2020 | Holt | F25J 1/0052 | |
| 11,136,104 | B2 * | 10/2021 | Lee | F25J 1/0279 | |
| 11,255,602 | B2 * | 2/2022 | Zielinski | F25J 1/0231 | |
| 11,512,402 | B2 * | 11/2022 | Bairamijamal | C07C 41/01 | |
| 11,624,555 | B2 * | 4/2023 | Krishnamurthy | F25J 1/0095 | 62/115 |
| 11,644,234 | B2 * | 5/2023 | Holt | F25J 1/0042 | 62/611 |
| 11,738,829 | B2 * | 8/2023 | Kim | F25J 1/0229 | 62/611 |
| 11,859,873 | B2 * | 1/2024 | Lee | F25B 41/00 | |
| 11,927,375 | B2 * | 3/2024 | Gallant | F28F 1/32 | |
| 2002/0170312 | A1 * | 11/2002 | Reijnen | F25J 1/0214 | 62/611 |
| 2006/0266074 | A1 * | 11/2006 | Groll | F25B 1/10 | 62/324.1 |
| 2010/0058803 | A1 * | 3/2010 | Ransbarger | F25J 1/0249 | 62/612 |
| 2016/0061495 | A1 * | 3/2016 | Sillato | F25B 40/00 | 62/498 |
| 2019/0162468 | A1 * | 5/2019 | Krishnamurthy | F25J 1/0245 | |
| 2020/0217585 | A1 * | 7/2020 | Krishnamurthy | F25J 1/0245 | |
| 2021/0356177 | A1 * | 11/2021 | Kumakura | F25B 40/02 | |
| 2022/0186986 | A1 * | 6/2022 | Kim | F25J 1/0262 | |
| 2023/0266059 | A1 * | 8/2023 | Kim | F25J 1/0022 | 62/613 |
| 2023/0375261 | A1 * | 11/2023 | Zhang | F25J 1/0085 | |

FOREIGN PATENT DOCUMENTS

| | | | | |
|---|---|---|---|---|
| JP | 2019095175 A * | 6/2019 | | F25B 1/10 |
| KR | 10-1009853 | 1/2011 | | |
| KR | 10-2012-0103408 | 9/2012 | | |
| KR | 10-2012-0103414 | 9/2012 | | |
| KR | 10-1357720 | 2/2014 | | |
| KR | 10-1617021 | 4/2016 | | |
| KR | 10-2018-0074656 | 7/2018 | | |
| KR | 10-2018-0085518 | 7/2018 | | |
| KR | 1940259 B1 * | 1/2019 | | B63B 25/16 |
| KR | 10-1945473 | 4/2019 | | |
| KR | 10-1966980 | 4/2019 | | |
| WO | 2005/071333 | 8/2005 | | |

OTHER PUBLICATIONS

International Preliminary Report on Patentability (Chapter I) for PCT/KR2019/003789 issued on Sep. 28, 2021 from WIPO (now published as WO 2020/204218).
International Search Report for PCT/KR2019/003789 mailed on Jan. 17, 2020 and its English translation from WIPO (now published as WO 2020/204218).
Written Opinion of the International Searching Authority for PCT/KR2019/003789 mailed on Jan. 17, 2020 and its English translation by Google Translate (now published as WO 2020/204218).

* cited by examiner

【FIG. 1】
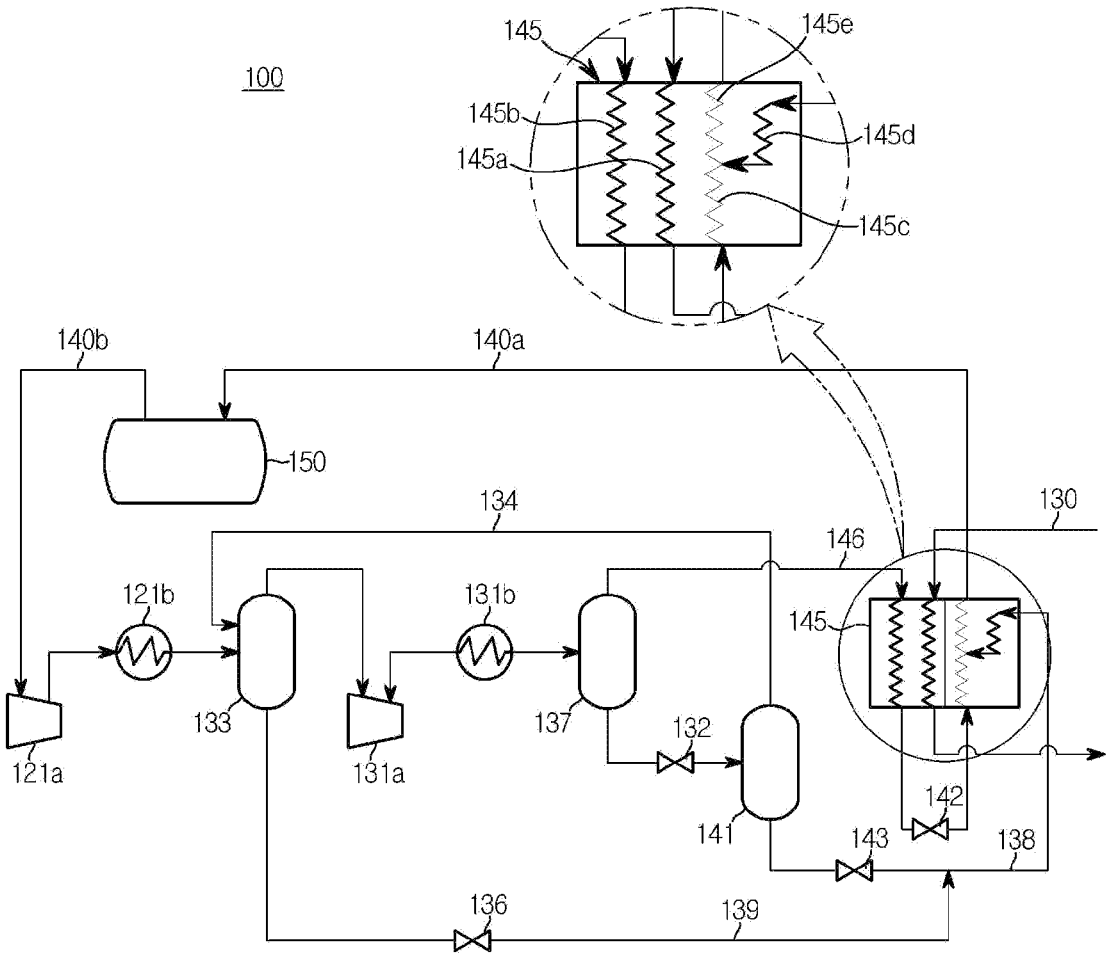

【FIG. 2】
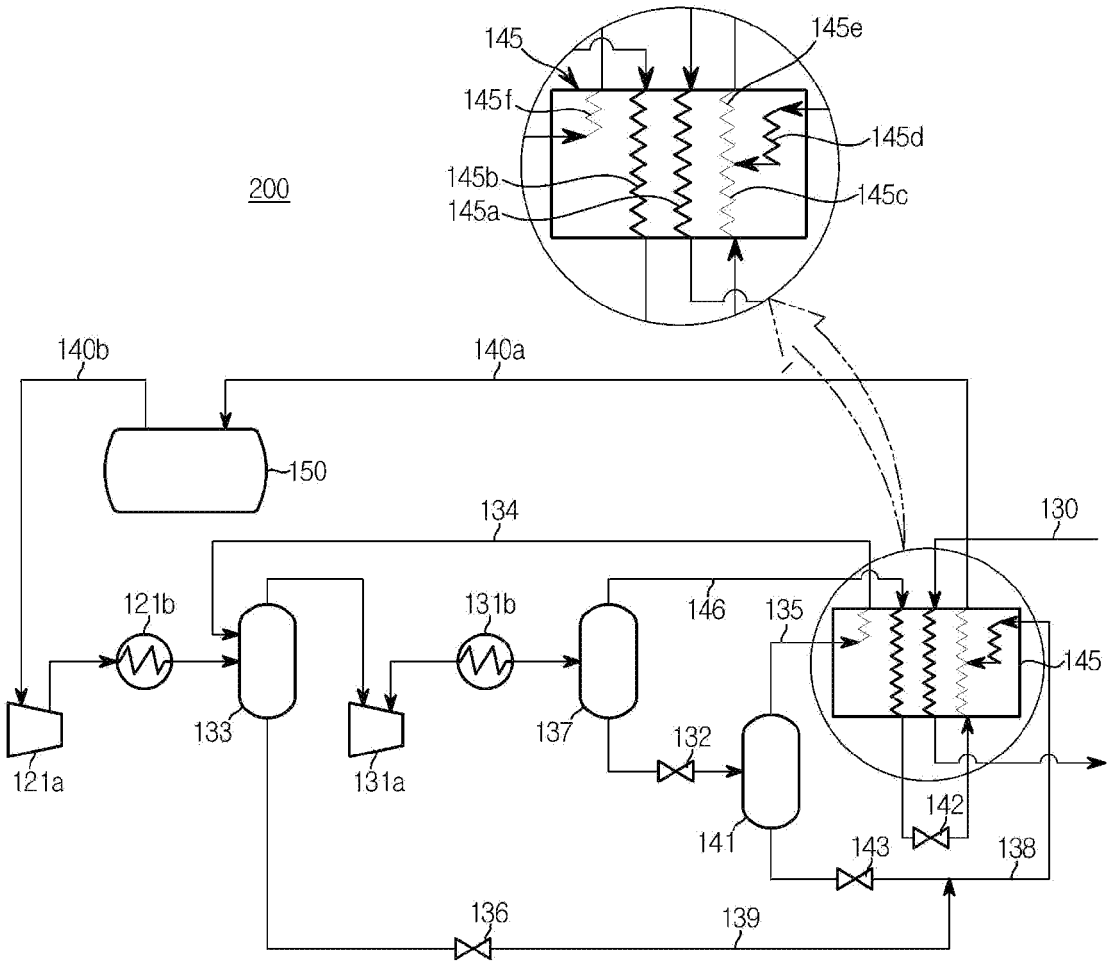

COOLING SYSTEM

CROSS-REFERENCE TO RELATED APPLICATION

This application is the national stage of International Application No. PCT/KR2019/003789, filed on Apr. 1, 2019, the disclosure of which is incorporated by reference herein in its entirety.

TECHNICAL FIELD

The disclosure relates to a cooling system, and more particularly, to a cooling system capable of improving overall efficiency of a liquefaction process.

BACKGROUND ART

As regulations of an International Maritime Organization (IMO) regarding the emission of greenhouse gases and various air pollutants have been reinforced in shipbuilding and shipping industries, the use of natural gases, which is clean energy sources, as fuel gases for a ship, instead of the use of existing fuels like heavy oil and diesel oil, is increasing.

To facilitate storage and transport, natural gases are managed and operated by changing the phase to liquefied natural gases (LNG). Here, LNG refers to a colorless and transparent cryogenic liquid whose volume is reduced to 1/600 by cooling it to about −162° C.

LNG may be accommodated in an insulated storage tank installed in a ship body to store and transport. However, because completely insulating and accommodating LNG is not practically easy, external heat is continuously transmitted to an inside of the storage tank such that an object to be cooled generated by vaporizing LNG is accumulated in the storage tank. The object to be cooled may increase an internal pressure of the storage tank, which results in deformation and damage of the storage tank. Accordingly, treating and removing an object to be cooled is required.

Conventionally, a method of flowing an object to be cooled through a vent mast provided on an upper side of the storage tank or burning the object to be cooled using a gas combustion unit (GCU) has been used, but this is undesirable in terms of energy efficiency. Recently, a method of supplying the object to be cooled together with liquefied natural gas or as fuel gas to the engine of a ship, respectively, or re-liquefying the object to be cooled using a re-liquefaction device such as a refrigeration cycle has been used.

A conventional liquefaction device for an object to be cooled includes a system that uses a refrigerant that combines C1 to C5 hydrocarbon with nitrogen, hydrogen, helium, etc., compresses and cools the refrigerant flowing through a compression unit, and then liquefies an object to be cooled through heat exchange between the refrigerant and the object to be cooled.

On the other hand, as a gas component in the compression unit located in the low pressure unit increases, cold heat effect that may occur compared to energy consumed decreases. In other words, the greater the gas capacity present in the low-pressure unit, the lower overall efficiency of liquefaction system.

Accordingly, development of a liquefaction system or liquefaction cycle capable of reducing the gas capacity present in a low pressure unit by preventing the vaporized refrigerant after heat exchange from being recirculated to the low pressure unit has been required.

DISCLOSURE

Technical Problem

The disclosure provides a cooling system capable of improving liquefaction efficiency and performance of a liquefaction system.

Further, the disclosure provides a cooling system capable of improving energy efficiency by reducing an amount of gas capacity delivering to a low pressure unit.

Further, the disclosure provides a cooling system capable of promoting an efficient facility operation with simple structure.

Further, the disclosure provides a cooling system capable effectively controlling and maintaining an operating efficiency of a heat exchanger by increasing an amount of refrigerant circulating through the heat exchanger.

Technical Solution

In accordance with an aspect of the disclosure, a cooling system includes a refrigerant circulator which circulates a refrigerant, wherein the refrigerant circulator includes a first compressor configured to pressurize the refrigerant in gaseous state; a first cooler configured to cool the refrigerant pressurized by the first compressor; a first gas-liquid separator configured to separate the refrigerant cooled by the first cooler into a first refrigerant flow of a gas component and a second refrigerant flow of a liquid component; a second compressor configured to pressurize the first refrigerant flow; a second cooler configured to cool the first refrigerant flow pressurized by the second compressor; a second gas-liquid separator configured to separate the refrigerant cooled by the second cooler into a third refrigerant flow of a gas component and a fourth refrigerant flow of a liquid component; a first expansion member configured to decompress the fourth refrigerant flow; an economizer configured to separate the fourth refrigerant flow decompressed by the first expansion member into a fifth refrigerant flow of a gas component and a sixth refrigerant flow of a liquid component; and a first circulation line configured to supply the fifth refrigerant flow separated by the economizer to the first gas-liquid separator; wherein the refrigerant is a mixed refrigerant.

The economizer may be configured as two or more multi-stage economizers.

The refrigerant circulator may further include a second expansion member configured to decompress the third refrigerant flow; and a third expansion member configured to decompress the sixth refrigerant flow.

The cooling system may further include a cooling line configured to receive and supercool an object to be cooled; and a heat exchanger provided between the cooling line and the refrigerant circulator and configured to exchange heat with the object to be cooled and the refrigerant, wherein the heat exchanger includes a first heat exchanger configured to supercool the object to be cooled, a second heat exchanger provided between a rear end of the second gas-liquid separator and a front end of the second expansion member to cool the third refrigerant flow, a third heat exchanger that is provided at a rear end of the second expansion member and transfers cold heat of the third refrigerant flow decompressed by the second expansion member, a fourth heat exchanger configured to pre-cool the sixth refrigerant flow decompressed by the third expansion member, and a fifth heat exchanger in which the third refrigerant flow passing through the third heat exchanger and the sixth refrigerant flow passing through the fourth heat exchanger are joined into a seventh refrigerant flow to exchange heat with the object to be cooled.

The refrigerant circulator may further include a second circulation line including first heat exchanger supply lines configured to supply the seventh refrigerant flow completely vaporized by the fifth heat exchanger to the first compressor, a second heat exchanger supply line configured to supply the third refrigerant flow to the second heat exchanger, and a third heat exchanger supply line configured to supply the sixth refrigerant flow to the fourth heat exchanger, and a second refrigerant flow supply line provided so that an outlet end thereof joins the third heat exchanger supply line and configured to supply the second refrigerant flow decompressed by the fourth expansion member.

The first heat exchanger supply lines may include a storage tank supply line configured to supply the seventh refrigerant flow completely vaporized by the fifth heat exchanger to a refrigerant storage tank; and a compressor supply line configured to supply the seventh refrigerant flow from the refrigerant storage tank to the first compressor.

The heat exchanger may further include a sixth heat exchanger configured to pre-cool with the fifth refrigerant flow, and the second circulation line further comprises a fourth heat exchanger supply line configured to supply the fifth refrigerant flow to the sixth heat exchanger.

Advantageous Effects

The cooling system of the disclosure may improve liquefaction efficiency and performance of the object to be cooled.

The cooling system of the disclosure may improve energy efficiency.

The cooling system of the disclosure may have a simple structure resulting in promoting the efficient facility operation.

The cooling system of the disclosure may control and maintain effectively operating efficiency of the heat exchanger.

DESCRIPTION OF DRAWINGS

FIG. 1 is a conceptual diagram illustrating a cooling system including a refrigerant circulator according to an embodiment of the disclosure.

FIG. 2 is a conceptual diagram illustrating a cooling system including a refrigerant circulator according to another embodiment of the disclosure.

MODES OF THE INVENTION

Hereinafter, the embodiments of the disclosure will be described in detail with reference to accompanying drawings. It should be understood that the terms used in the specification and the appended claims should not be construed as limited to general and dictionary meanings, but interpreted based on the meanings and concepts corresponding to technical aspects of the disclosure on the basis of the principle that the inventor is allowed to define terms appropriately for the best explanation. Therefore, the description proposed herein is just a preferable example for the purpose of illustrations only, not intended to limit the scope of the disclosure, so it should be understood that other equivalents and modifications could be made thereto without departing from the spirit and scope of the disclosure.

FIG. 1 is a conceptual diagram illustrating a cooling system 100 including a refrigerant circulator according to an embodiment of the disclosure.

Referring to FIG. 1, the cooling system 100 including a refrigerant circulator according to an embodiment of the disclosure includes a cooling line 130 for receiving and supercooling an object to be cooled, the refrigerant circulator through which a refrigerant circulates, and a heat exchanger 145 provided between the cooling line 130 and the refrigerant circulator and exchange heat between the object to be cooled and the refrigerant. The cooling system 100 including the refrigerant circulator configured as described above is merely an example, and the disclosure is not limited thereto.

As a device for driving the cooling systems 100 and 200 according to the embodiment of the disclosure, any configuration may be used as long as it may liquefy the object to be cooled such as boil-off gas generated from liquefied gas such as LNG.

The above-described cooling system may include a refrigeration cycle in which a refrigerant is circulated, and a mixed refrigerant may be used as the refrigerant. Meanwhile, an example of a preferred mixed refrigerant that may be applied to embodiments of the disclosure will be described later. On the other hand, the object to be cooled is supplied to the cooling system through the cooling line 130. The object to be cooled supplied to the cooling system is cooled by the refrigerant while passing through a cold box, for example, the heat exchanger 145 and liquefied.

The refrigerant circulator is provided to receive the refrigerant of a gas component pressurized while passing through first and second compressors 121*a* and 131*a* and re-liquefy the refrigerant.

The refrigerant circulator includes the first compressor 121*a* for pressurizing the refrigerant in gaseous state, a first cooler 121*b* for cooling the refrigerant pressurized by the first compressor, and a first gas-liquid separator 133 that separates the refrigerant cooled by the first cooler 121*b* into a first refrigerant flow of a gas component and a second refrigerant flow of a liquid component.

At this time, the first refrigerant flow of the gas component having a low density is separated by an upper line, and the second refrigerant flow of the liquid component having a relatively high density is separated by a lower line. The separated liquid second refrigerant flow may then be expanded under reduced pressure by a fourth expansion member 136.

Furthermore, the above-described refrigerant circulator includes a second compressor 131*a* for pressurizing the first refrigerant flow, a second cooler 131*b* for cooling the first refrigerant flow pressurized by the second compressor, a second gas-liquid separator 137 for separating the first refrigerant flow cooled by the second cooler into a third refrigerant flow of a gas component and a fourth refrigerant flow of a liquid component, a second expansion member 142 for decompressing the third refrigerant flow, and a first expansion member 132 for decompressing the fourth refrigerant flow.

Furthermore, the refrigerant circulator is provided to include an economizer 141 that separates the fourth refrigerant flow into a fifth refrigerant flow, which is a gas component generated by reducing the pressure and expanding the fourth refrigerant flow by the first expansion member 132, and a sixth refrigerant flow, which is the remaining gas component thereof. At this time, the sixth refrigerant flow may be reduced in pressure by a third expansion member 143. Furthermore, the above-described refrigerant circulator includes a first circulation line 134 for supplying the fifth refrigerant flow to the first gas-liquid separator 133.

The first refrigerant flow pressurized by the second compressor 131*a* may be set to have a pressure of 10 to 200 barG, more preferably 15 to 150 barG. Herein, when the pressure of the first refrigerant flow pressurized from the second compressor 131*a* is set to be less than 15 barG, a rate of pressure loss generated by using cold heat in devices disposed at rear end compared to the energy required for pressurization (ex., the heat exchanger 145) increases, there is a problem in terms of the efficiency of the cooling system. Furthermore, when the pressure of the first refrigerant flow pressurized from the second compressor 131*a* is set to exceed 150 barG, in consideration of the phenomenon that the boiling point of the first refrigerant flow is increased accordingly, a refrigerant having a low boiling point and a small molecular weight in the first place should be added, but such a refrigerant has a problem that the efficiency of the liquefaction process is generally low.

The above-described first to fourth expansion members 132, 142, 143, and 136 may have any configuration as long as they may reduce a refrigerant flow, and may be provided as, for example, an expansion valve or an expander.

On the other hand, in a general cooling system, most of the gas component of a circulating heating medium is recirculated to a compressor of a low pressure unit and undergoes a compression process, and then passes through an expansion process through reduced pressure to supply cold heat to the heat exchanger. Herein, when the gas component is decompressed and expanded through the compressor at the same pressure ratio, as the pressure condition is lowered, the amount of generated cold heat decrease and the compression energy for subsequent compression increases, thereby causing a problem in energy efficiency.

As described above, the second gas-liquid separator 137 separates the first refrigerant flow into the fourth refrigerant flow in the liquid phase, and the pressure may be reduced by the first expansion member 132. The fourth refrigerant flow in a decompressed and expanded state exists in a state in which a gas component and a liquid component are mixed, and the lower the pressure condition of the above-described gas component, the lower the cooling efficiency obtained compared to the input compression energy.

Accordingly, the cooling system 100 according to the embodiment of the disclosure may reduce the capacity of the first compressor 121*a* to improve the overall efficiency of the cooling system by including the economizer 141 that separates the fifth refrigerant flow of the gas component and the sixth refrigerant flow of the liquid component from the fourth refrigerant flow, and circulates the fifth refrigerant flow of the gas component to a front end of the second compressor 131*a* under high pressure condition.

At this time, the fifth refrigerant flow in the gas phase separated by the economizer 141 may be circulated by being supplied to the first gas-liquid separator 133 provided in front of the second compressor 131*a* through the first circulation line 134 in the refrigerant circulator as described above.

The heat exchanger 145 may include a first heat exchanger 145*a* for supercooling an object to be cooled, a second heat exchanger 145*b* provided between a rear end of the second gas-liquid separator 131*a* and a front end of the second expansion member 142 to cool the third refrigerant flow, a third heat exchanger 145*c* that is provided at a rear end of the second expansion member 142 and transfers cold heat of the third refrigerant flow decompressed by the second expansion member, a fourth heat exchanger 145*d* for pre-cooling the sixth refrigerant flow decompressed by the third expansion member 143, and a fifth heat exchanger 145*e* in which the third refrigerant flow passing through the third heat exchanger 145*c* and the sixth refrigerant flow passing through the fourth heat exchanger 145*d* are joined into a seventh refrigerant flow to exchange heat with the object to be cooled.

The refrigerant circulator may include a second circulation line and a second refrigerant flow supply line 139.

The above-described second circulation line includes first heat exchanger supply lines 140*a* and 140*b*, a second heat exchanger supply line 146, and a third heat exchanger supply line 138. Furthermore, the above-mentioned second refrigerant flow supply line is provided to supply the second refrigerant flow decompressed by the fourth expansion member 136.

The third refrigerant flow in the gas phase separated by the second gas-liquid separator 137 may be supplied to the second heat exchanger 145*b* through the second heat exchanger supply line 146.

Thereafter, the third refrigerant flow that has passed through the second heat exchanger 145*b* is expanded under reduced pressure through the second expansion member 142, and is supplied to the heat exchanger 145 again to transfer cold heat of the third refrigerant flow to the third heat exchanger 145*c* therein.

Accordingly, the refrigerant supplied to the second expansion member 142 is configured to be able to exchange heat with the refrigerant in a cryogenic state after expansion while passing through the heat exchanger 145 before expansion.

The second expansion member 142 may be provided at the rear end of the second heat exchanger 145*b*. The second expansion member 142 may implement cooling and re-liquefaction by decompressing the third refrigerant flow of the gas component that has passed through the second heat exchanger 145*b*.

The second expansion member 142 may be, for example, a Joule-Thomson valve. The second expansion member 142 may reduce the third refrigerant flow passing through the second heat exchanger 145*b* to a pressure level corresponding to the gas pressure condition required by the system.

The sixth refrigerant flow in the liquid phase separated by the economizer 141 is supplied to the fourth heat exchanger 145*d* through the third heat exchanger supply line 138.

At this time, the above-described sixth refrigerant flow is provided to enable pre-cooling by being expanded by the third expansion member 143 under reduced pressure and delivered to the fourth heat exchanger 145*d*.

On the other hand, the second refrigerant flow supply line 139 for supplying the second refrigerant flow decompressed by the fourth expansion member 136 is provided so that an outlet end thereof joins the third heat exchanger supply line 138. Accordingly, the second refrigerant flow flowing through the second refrigerant flow supply line 139 and the sixth refrigerant flow flowing through the third heat exchanger supply line 138 are mixed and then supplied to the fourth heat exchanger 145*d* through one third heat exchanger supply line 138.

Herein, the third refrigerant flow is provided to be sub-cooled after the object to be cooled undergoes a liquefaction process through heat exchange with the object to be cooled flowing through the cooling line 130 passing through the third heat exchanger 145*c*.

Accordingly, the third refrigerant flow passing through the third heat exchanger 145*c* and the sixth refrigerant flow passing through the fourth heat exchanger 145*d* are joined into the seventh refrigerant flow in the fifth heat exchanger. Thereafter, the above-described seventh refrigerant flow is provided so that the object to be cooled is pre-cooled through heat exchange with the object to be cooled flowing through the cooling line 130 in the fifth heat exchanger.

The first heat exchanger supply lines 140*a* and 140*b* supply the seventh refrigerant flow completely vaporized by the fifth heat exchanger to the first compressor 121*a*. The seventh refrigerant flow is completely vaporized by providing cold heat to the fifth heat exchanger, and passes through the fifth heat exchanger in a gaseous state.

A refrigerant storage tank 150 for collecting the seventh refrigerant flow in the gas phase may be provided at an intermediate point of the first heat exchanger supply lines 140*a* and 140*b*. The seventh refrigerant flow in the gas phase that has passed through the fifth heat exchanger is supplied to the refrigerant storage tank 150 to be circulated to the first compressor 121*a*.

Accordingly, the first heat exchanger supply lines 140*a* and 140*b* includes the first storage tank supply line 140*a* for supplying the seventh refrigerant flow to the refrigerant storage tank 150, and a compressor supply line 140*b* for supplying the refrigerant collected in the refrigerant storage tank 150 to the first compressor 121*a*.

Meanwhile, a mixed refrigerant applicable to the embodiments of the disclosure may be a refrigerant in which C1-C5 hydrocarbons and nitrogen, hydrogen, helium, and the like are combined. More specifically, the mixed refrigerant contains nitrogen and methane, and may further contain ethylene and propane having a higher boiling point than this, and may further contain iso-pentane having a higher boiling point than this.

On the other hand, the temperature difference between the above-described first to seventh refrigerant flows and a feed gas as an object to be cooled is defined as an approach temperature. More specifically, in the fifth heat exchanger 145*e* in which heat exchange occurs between the seventh refrigerant flow in the heat exchanger 145 and the object to be cooled, the temperature difference between the seventh refrigerant flow and the object to be cooled may be defined as the approach temperature of the heat exchanger 145. The approach temperature of the heat exchanger 145 is predetermined within a predetermined range from a viewpoint of heat transfer efficiency, the capacity of the first and second compressors 121*a* and 131*a*, and economy. In this case, the above-described approach temperature is a value proportional to a heat transfer amount of the heat exchanger 145. The composition ratio between the components of the mixed refrigerant, which will be described later, is predetermined so that the above-described approach temperature has a value in a predetermined range, for example, 1 to 15° C. under the temperature condition of the liquefaction process according to the types of the object to be cooled. At this time, if the approach temperature is set lower than 1° C., the heat transfer area for transferring the same amount of heat is set excessively wide, resulting in economic loss. Conversely, if the approach temperature is set higher than 15° C., the temperature of the refrigerant flow is further lowered and for this, the pressure of the compressor applied to the refrigerant is increased. In this process, as compression energy required for the compressor increases, the efficiency of the compressor and the production efficiency of the process are reduced.

The composition ratio of nitrogen to the entire mixed refrigerant is 5 mol % or more, more preferably 5 to 20 mol %, and the composition ratio of methane is 20 mol % or more, more preferably 20 to 40 mol %. When nitrogen and methane, which have relatively low boiling points, are contained in small amounts below the above-described ranges, the efficiency of the liquefaction process of the object to be cooled, for example, LNG or a boiled-off gas (BOG) containing methane as a main component, is reduced.

The composition ratio of ethylene is 35 mol % or less, more preferably 10 to 35 mol %. In this case, ethane may be used instead of ethylene. Moreover, the composition ratio of propane is 35 mol % or less, more preferably, 10 to 35 mol %. When ethylene and propane are contained in excess of 35 mol % or more in the liquefaction process of the object to be cooled, for example, LNG or BOG whose main component is methane, the boiling point of the mixed refrigerant rises and the approach temperature of the heat exchanger 145 corresponding to the temperature of the above-described liquefaction process falls below a predetermined range, thereby reducing the heat transfer amount of the heat exchanger 145.

The composition ratio of iso-pentane is 20 mol % or less, more preferably 5 to 20 mol %. In this case, iso-butane may be used instead of iso-pentane, or iso-pentane and iso-butane are used in combination, but the total composition ratio of iso-pentane and iso-butane is 20 mol % or less, more preferably may be used so as to be 5 to 20 mol %. When the above-mentioned composition ratio is 5 mol % or less, the refrigerant that covers the high temperature part in the mixed refrigerant is insufficient. To overcome this, it is necessary to increase the amount of refrigerant having a large molecular weight, which leads to increase in the flow rate of the compressor, and thus the efficiency of the entire liquefaction process may be reduced. Similarly, when the above-mentioned composition ratio in the mixed refrigerant is contained in excess of 20 mol % or more, in the liquefaction process of the object to be cooled having a low-temperature freezing point as a physical property, the approach temperature of the heat exchanger 145 falls below a predetermined range, thereby reducing the heat transfer amount of the heat exchanger 145.

As the cooling systems 100 and 200 including the refrigerant circulator, for example, a non-flammable mixed refrigerant may be used. The non-flammable mixed refrigerant formed by mixing a plurality of non-flammable refrigerants has a mixed composition ratio such that it does not condense even at a liquefaction temperature in which BOG compressed to medium pressure is re-liquefied. The refrigeration cycle using phase change of the mixed refrigerant is more efficient than the nitrogen gas refrigeration cycle using only nitrogen as the refrigerant. The non-flammable mixed refrigerant may include, for example, argon, a hydro-fluorocarbon refrigerant, and a mixed refrigerant including a fluorocarbon refrigerant. Furthermore, as the cooling systems 100 and 200 including the refrigerant circulator, of course, not only the above-described non-flammable mixed refrigerant, but also a flammable mixed refrigerant may be used.

On the other hand, the mixed refrigerant according to the embodiment of the disclosure may be used as not only a Single Mixed Refrigerant (SMR) but also a Double Mixed Refrigerant (DMR), or may be applied to three or more closed loop cascades.

FIG. 2 is a conceptual diagram illustrating a cooling system 200 according to another embodiment of the disclosure.

Referring to FIG. 2, a cooling system 200 according to another embodiment of the disclosure includes a cooling line that for receiving and supercooling an object to be cooled, the heat exchanger 145 provided between the cooling line and the refrigerant circulator and exchange heat between the object to be cooled and the refrigerant. The refrigerant circulator includes the first compressor 121*a* for pressurizing the refrigerant in gaseous state, the first cooler 121*b* for cooling the refrigerant pressurized by the first compressor, the first gas-liquid separator 133 that separates the refrigerant cooled by the first cooler 121*b* into the gas component first refrigerant flow and the liquid component second refrigerant flow, the second compressor 131*a* for pressurizing the first refrigerant flow, the second cooler 131*b* for cooling the first refrigerant flow pressurized by the second compressor, the second gas-liquid separator 137 for separating the first refrigerant flow cooled by the second cooler into the gas component third refrigerant flow and the liquid component fourth refrigerant flow, the second expansion member 142 for decompressing the third refrigerant flow, the first expansion member 132 for decompressing the fourth refrigerant flow, the economizer 141 that separates the fourth refrigerant flow decompressed by the first expansion member into the fifth refrigerant flow in a gaseous state and the sixth refrigerant flow in liquid state, and the third expansion member 143 for decompressing the sixth refrigerant flow. Furthermore, the above-described refrigerant circulator includes the first circulation line 134 for supplying the fifth refrigerant flow to the first gas-liquid separator 133.

The heat exchanger 145 may include the first heat exchanger 145*a* for supercooling the object to be cooled, the second heat exchanger 145*b* provided between the rear end of the second gas-liquid separator 131*a* and the front end of the second expansion member 142 to cool the third refrigerant flow, the third heat exchanger 145*c* that is provided at the rear end of the second expansion member 142 and transfers cold heat of the third refrigerant flow decompressed by the second expansion member, the fourth heat exchanger 145*d* for pre-cooling the sixth refrigerant flow decompressed by the third expansion member 143, and the fifth heat exchanger 145*e* in which the third refrigerant flow passing through the third heat exchanger 145*c* and the sixth refrigerant flow passing through the fourth heat exchanger 145*d* are joined into the seventh refrigerant flow to exchange heat with the object to be cooled.

The refrigerant circulator further includes the second circulation line including the first heat exchanger supply lines 140*a* and 140*b*, the second heat exchanger supply line 146, and the third heat exchanger supply line 138 for supplying the sixth refrigerant flow to the fourth heat exchanger 145*d*, and the second refrigerant flow supply line 139 for supplying the second refrigerant flow decompressed by the fourth expansion member 136 is provided so that an outlet end thereof joins the third heat exchanger supply line 138.

At this time, the heat exchanger 145 further includes a sixth heat exchanger 145*f* for pre-cooling with the fifth refrigerant flow, and the above-described second circulation line further includes a fourth heat exchanger supply line 135 for supplying the above-described fifth refrigerant flow to the sixth heat exchanger 145*f*.

In other words, the cooling system 200 according to another embodiment of the disclosure may apply cold heat to the heat exchanger 145 by supplying the fifth refrigerant flow to the sixth heat exchanger 145*f* through the fourth heat exchanger supply line 135, and then control the fifth refrigerant flow to be supplied to the first circulation line 134.

The fourth heat exchanger supply line 135 transfers the fifth refrigerant flow in the gas phase separated through the economizer 141. Accordingly, the fifth refrigerant flow in the gas phase separated from the economizer 141 is supplied as the refrigerant to the sixth heat exchanger 145*f* through the fourth heat exchanger supply line 135, thereby improving the cooling effect of the heat exchanger 145.

On the other hand, in FIGS. 1 and 2, the cooling systems 100 and 200 according to the disclosure are shown as having first and second compressors 121*a* and 131*a*, which are two-stage compressors, and one economizer 141. However, when a multi-stage compressor is provided, it may include a case in which two or more multi-stage economizers are added in response to the number of provided compressors. For example, when a three-stage compressor is used, a two-stage economizer may be provided, and when a four-stage compressor is used, a three-stage economizer may be provided.

Furthermore, as shown in FIGS. 1 and 2, in the cooling systems 100 and 200 according to the disclosure, as soon as the fifth refrigerant flow is separated from the economizer 141, it is supplied to the first gas-liquid separator 133 provided in front of the second compressor 131*a* through the first circulation line 134, or the fifth refrigerant flow is supplied to the first circulation line 134 after cold heat to the sixth heat exchanger 145*f* passing through the fourth heat exchanger supply line 135. However, the disclosure is not limited thereto.

For example, the cooling systems 100 and 200 according to the disclosure may include both the first circulation line 134 and the fourth heat exchanger supply line 135 as the refrigerant circulator through which the fifth refrigerant flow separated from the economizer 141 may pass. Accordingly, depending on the operating mode and efficiency of the system, the cooling systems 100 and 200 may selectively control a flow directly passing through the first circulation line 134 without the fifth refrigerant flow being supplied to the inside of the heat exchanger, or a flow providing cold heat to the heat exchanger 145 by being supplied to the sixth heat exchanger 145*f*.

As a result, the above-described cooling system separates the refrigerant in gaseous state generated through the expansion member through the economizer 141 and delivers the refrigerant to the front end of the second compressor 131*a* so that it may be pressurized to a high pressure condition, thereby improving the liquefaction efficiency and performance of the object to be cooled.

Furthermore, when the fifth refrigerant flow passing through the economizer 141 is controlled so that only the first circulation line 134 is supplied, the liquefaction process may be easily performed by simplifying a piping structure in the heat exchanger 145. In addition, when controlling the fifth refrigerant flow passing through the economizer 141 to be supplied to the first circulation line 134 through the fourth heat exchanger supply line 135, cooling efficiency may be improved by increasing the amount of refrigerant, which is a material that may cool the object to be cooled, due to the driving of the heat exchanger 145.

While the disclosure has been shown and described with reference to certain exemplary embodiments thereof, it will be understood by those skilled in the art that various changes in form and details may be made therein without departing from the spirit and scope of the disclosure as defined by the appended claims.

The invention claimed is:

1. A cooling system, comprising:

a refrigerant circulator which circulates a refrigerant, wherein the refrigerant circulator comprises:

a first compressor configured to pressurize the refrigerant in gaseous state;

a first cooler configured to cool the refrigerant pressurized by the first compressor;

a first gas-liquid separator configured to separate the refrigerant cooled by the first cooler into a first refrigerant flow of a gas component and a second refrigerant flow of a liquid component;

a second compressor configured to pressurize the first refrigerant flow;

a second cooler configured to cool the first refrigerant flow pressurized by the second compressor;

a second gas-liquid separator configured to separate the refrigerant cooled by the second cooler into a third refrigerant flow of a gas component and a fourth refrigerant flow of a liquid component;

a first expansion member configured to decompress the fourth refrigerant flow;

an economizer configured to separate the fourth refrigerant flow decompressed by the first expansion member into a fifth refrigerant flow of a gas component and a sixth refrigerant flow of a liquid component; and a first circulation line configured to supply the fifth refrigerant flow separated by the economizer to the first gas-liquid separator;

wherein the refrigerant is a mixed refrigerant.

2. The cooling system of claim 1, wherein the economizer is configured as two or more multi-stage economizers.

3. The cooling system of claim 1, wherein the refrigerant circulator further comprises:

a second expansion member configured to decompress the third refrigerant flow; and a third expansion member configured to decompress the sixth refrigerant flow.

4. The cooling system of claim 3, further comprising:

a cooling line configured to receive and supercool an object to be cooled; and a heat exchanger provided between the cooling line and the refrigerant circulator and configured to exchange heat with the object to be cooled and the refrigerant, wherein the heat exchanger comprises:

a first heat exchanger configured to supercool the object to be cooled, a second heat exchanger provided between a rear end of the second gas-liquid separator and a front end of the second expansion member to cool the third refrigerant flow, a third heat exchanger that is provided at a rear end of the second expansion member and transfers cold heat of the third refrigerant flow decompressed by the second expansion member, a fourth heat exchanger configured to pre-cool the sixth refrigerant flow decompressed by the third expansion member, and a fifth heat exchanger in which the third refrigerant flow passing through the third heat exchanger and the sixth refrigerant flow passing through the fourth heat exchanger are joined into a seventh refrigerant flow to exchange heat with the object to be cooled.

5. The cooling system of claim 4, wherein the refrigerant circulator further comprises:

a second circulation line including first heat exchanger supply lines configured to supply the seventh refrigerant flow completely vaporized by the fifth heat exchanger to the first compressor, a second heat exchanger supply line configured to supply the third refrigerant flow to the second heat exchanger, and a third heat exchanger supply line configured to supply the sixth refrigerant flow to the fourth heat exchanger, and a second refrigerant flow supply line provided so that an outlet end thereof joins the third heat exchanger supply line and configured to supply the second refrigerant flow decompressed by the fourth expansion member.

6. The cooling system of claim 5, wherein

The first heat exchanger supply lines comprise:

a storage tank supply line configured to supply the seventh refrigerant flow completely vaporized by the fifth heat exchanger to a refrigerant storage tank; and a compressor supply line configured to supply the seventh refrigerant flow from the refrigerant storage tank to the first compressor.

7. The cooling system of claim 5, wherein the heat exchanger further comprises a sixth heat exchanger configured to pre-cool with the fifth refrigerant flow, and the second circulation line further comprises a fourth heat exchanger supply line configured to supply the fifth refrigerant flow to the sixth heat exchanger.

* * * * *